US007018496B1

(12) United States Patent
George et al.

(10) Patent No.: US 7,018,496 B1
(45) Date of Patent: Mar. 28, 2006

(54) CURABLE MECHANICAL FASTENERS

(75) Inventors: Clayton A. George, Afton, MN (US); Paul D. Driscoll, Woodbury, MN (US); Stephen R. Hartshorn, Woodbury, MN (US); Morgan J. Tamsky, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/299,965

(22) Filed: Apr. 26, 1999

(51) Int. Cl.
*A44B 18/00* (2006.01)

(52) U.S. Cl. ..... 156/152; 156/307.7; 156/312; 428/99; 428/100; 24/304; 24/357

(58) Field of Classification Search ..... 156/152, 156/307.7, 312; 248/205.3; 24/304, DIG. 11, 24/357; 428/100, 99
See application file for complete search history.

(56) References Cited

U.S. PATENT DOCUMENTS 2,951,825 A 9/1960 Reinking et al.
3,018,262 A 1/1962 Schroeder
3,117,099 A 1/1964 Proops et al.
3,176,364 A 4/1965 Dritz
3,298,998 A 1/1967 McConnell et al.
3,469,490 A * 9/1969 Pearce, Jr. ..... 411/371.1
3,472,301 A 10/1969 Pearce, Jr.
3,562,223 A 2/1971 Bargain et al.
3,625,875 A * 12/1971 Frauenglass et al. ..... 523/176
3,627,780 A 12/1971 Bonnard
3,708,382 A * 1/1973 Erb ..... 428/92
3,746,068 A 7/1973 Deckert
3,814,156 A * 6/1974 Bachmann et al. ..... 411/258
3,839,358 A 10/1974 Bargain
4,076,869 A * 2/1978 Flynn ..... 156/330
4,155,327 A * 5/1979 Alexander et al. ..... 118/620
4,157,360 A 6/1979 Prevorsek et al.
4,239,829 A * 12/1980 Cohen ..... 24/DIG. 11
4,287,113 A 9/1981 Takashina et al.
4,356,050 A * 10/1982 Crivello et al. ..... 156/273.3
4,468,497 A 8/1984 Street et al.
4,478,544 A 10/1984 Strand
4,643,730 A 2/1987 Chen et al.
4,654,246 A 3/1987 Provost et al.
4,710,414 A 12/1987 Northrup et al.
4,822,443 A 4/1989 Dubowik
4,863,330 A * 9/1989 Olez et al. ..... 411/424
4,875,259 A * 10/1989 Appeldorn ..... 24/584.1
4,877,362 A 10/1989 Berecz et al.
4,903,440 A 2/1990 Kirk et al.
4,972,031 A 11/1990 Choate et al.

(Continued)

FOREIGN PATENT DOCUMENTS

EP 0 418 954 A2 3/1991

(Continued)

OTHER PUBLICATIONS

Modern Plastics Encyclopedia, 1983-1984, pp.46, 48, and 53, 5 total pages.*

(Continued)

*Primary Examiner*—Jeff H. Aftergut
(74) *Attorney, Agent, or Firm*—Nancy M. Lambert

(57) ABSTRACT

Curable mechanical fasteners of the invention comprise a fastening surface comprising a curable material, wherein the fastening surface is capable of being repeatedly attached and unattached to a complementary fastening surface, and when attached to the complementary fastening surface and cured, the curable mechanical fastener is capable of becoming permanently attached to the complementary fastening surface. The curable mechanical fastener may also further comprise the complementary fastening surface.

24 Claims, 4 Drawing Sheets

U.S. PATENT DOCUMENTS

| | | | | | |
|---|---|---|---|---|---|
| 5,077,870 | A | * | 1/1992 | Melbye et al. | 24/452 |
| 5,086,088 | A | | 2/1992 | Kitano et al. | |
| 5,089,536 | A | | 2/1992 | Palazzotto | |
| 5,149,573 | A | | 9/1992 | Kobe et al. | |
| 5,178,646 | A | | 1/1993 | Barber, Jr. et al. | |
| 5,196,266 | A | * | 3/1993 | Lu et al. | 428/355 CN |
| 5,201,101 | A | | 4/1993 | Rouser et al. | |
| 5,242,646 | A | | 9/1993 | Torigoe et al. | |
| 5,252,694 | A | | 10/1993 | Willett et al. | |
| 5,264,059 | A | | 11/1993 | Jacaruso et al. | |
| 5,286,431 | A | | 2/1994 | Banfield et al. | |
| 5,316,849 | A | | 5/1994 | Lu et al. | |
| 5,332,783 | A | | 7/1994 | Dillman et al. | |
| 5,342,569 | A | | 8/1994 | Murasaki | |
| 5,348,782 | A | | 9/1994 | Arnold | |
| 5,366,846 | A | | 11/1994 | Knudsen et al. | |
| 5,405,477 | A | | 4/1995 | Arnold | |
| 5,407,978 | A | | 4/1995 | Bymark et al. | |
| 5,422,779 | A | | 6/1995 | Borkowicz et al. | |
| 5,426,130 | A | * | 6/1995 | Thurber et al. | 411/82 |
| 5,436,051 | A | | 7/1995 | Donaruma et al. | |
| 5,462,996 | A | | 10/1995 | Portelli et al. | |
| 5,589,246 | A | | 12/1996 | Calhoun et al. | |
| 5,607,635 | A | | 3/1997 | Melbye et al. | |
| 5,635,546 | A | | 6/1997 | Rich et al. | |
| 5,656,351 | A | * | 8/1997 | Donaruma | 428/92 |
| 5,657,516 | A | | 8/1997 | Berg et al. | |
| 5,677,376 | A | | 10/1997 | Groves | |
| 5,679,302 | A | | 10/1997 | Miller et al. | |
| 5,723,191 | A | | 3/1998 | Plamthottam et al. | |
| 5,725,341 | A | | 3/1998 | Hofmeister | |
| 5,756,185 | A | | 5/1998 | Lesser | |
| 5,798,163 | A | | 8/1998 | Gold | |
| 5,837,749 | A | | 11/1998 | Erickson et al. | |

FOREIGN PATENT DOCUMENTS

| | | | | | |
|---|---|---|---|---|---|
| EP | 0 426 359 | A2 | | 5/1991 | |
| EP | 0 620 259 | A2 | | 10/1994 | |
| EP | 0 894 448 | A1 | | 2/1999 | |
| GB | 1255413 | A | * | 12/1971 | |
| JP | 63-14756 | | * | 4/1988 | 248/205.3 |
| JP | 02-292318 | A2 | | 12/1990 | |
| WO | WO95/07170 | | | 3/1995 | |
| WO | WO95/20726 | A1 | | 8/1995 | |
| WO | WO96/32453 | | | 10/1996 | |
| WO | WO98/29231 | A | | 7/1998 | |
| WO | WO98/29516 | A | | 7/1998 | |
| WO | WO98/45382 | | | 10/1998 | |
| WO | WO99/08901 | | | 2/1999 | |
| WO | WO99/17630 | | | 4/1999 | |

OTHER PUBLICATIONS

Product Description Sheet on "3M™ Schotmate™ Hook and Loop Fasteners SJ3526," Apr. 9, 1998.

Product Description Sheet on "3M™ Dual Lock™ Reclosable Fastening System SJ3541," Apr. 9, 1998.

Z. W. Wicks, Jr., "Blocked Isocyanates," *Progress in Organic Coatings,* vol 3 (1975), pp. 73-99.

E. P. Plueddemann and G. Fanger, *J. Am. Chem. Soc. 81,* 2632-5 (1959).

Lee and Neville, "Curing of Epoxy Resins," pp. 30-140, McGraw-Hill Book Company, New York, 1957.

Kirk-Othmer, "Phenolic Resins," *Encyclopedia of Chemical Technology,* 3rd Ed., John Wiley & Sons, 1981, N.Y., vol. 17, p. 384-416.

B. D. Ludbrook, "High Performance Adhesives Meet Many Industry Needs," *Adhesives Age*, 33, No. 13, Dec. 1990, pp. 25-29.

"Epoxy Resins," *Encyclopedia of Polymer Science and Technology*, vol. 6, 1967, Interscience Publishers, N.Y., pp. 209-271.

* cited by examiner

CURABLE MECHANICAL FASTENERS

FIELD OF THE INVENTION

The present invention relates generally to reclosable curable mechanical fasteners fabricated from materials such that they are curable to provide permanent fasteners.

BACKGROUND OF THE INVENTION

Conventional reclosable mechanical fasteners releasably close, so as to allow later reopening. Known reclosable mechanical fasteners typically have fastenable surfaces fabricated from metal or thermoplastic resins. Examples of such thermoplastic resins include polyesters (e.g., poly(ethylene terephthalate)), polyamides, poly(styrene-acrylonitrile), poly(acrylonitrile-butadiene-styrene), polyolefins (e.g., polypropylene and polypropylene/polyethylene copolymers), and plasticized polyvinyl chloride.

Examples of reclosable mechanical fasteners include those sold under the VELCRO trade designation and which are available from Velcro USA, Inc. of Manchester, N.H. Other reclosable mechanical fasteners are sold under the SCOTCHMATE and DUAL LOCK trade designations and are available from Minnesota Mining & Manufacturing Co. of St. Paul, Minn. Such fasteners have found widespread use for fastening a variety of materials, such as clothing and diapers. Other uses for such fasteners include attaching interior panels in airplanes and automotive dashboards. Reclosable mechanical fasteners are also widely used for sealing food products, such as in plastic bags sold by S.C. Johnson Wax of Racine, Wis., under the trade designation ZIPLOC.

One disadvantage of many reclosable mechanical fasteners to date, however, is that they often do not have enough strength to be useful in some applications, such as in structural or semi-structural applications, where strength requirements may be very rigorous. Furthermore, reclosable mechanical fasteners that can provide permanent attachments are desired.

SUMMARY OF THE INVENTION

Curable mechanical fasteners of the invention are capable of being reclosably fastened and then permanently fastened, when desired. The permanent fasteners may also be useful in certain applications where strength requirements are rigorous.

In general, curable mechanical fasteners of the invention comprise a fastening surface comprising a curable material, wherein the fastening surface is capable of being repeatedly attached and unattached to a complementary fastening surface, and when attached to the complementary fastening surface and cured, the curable mechanical fastener is capable of becoming permanently attached to the complementary fastening surface. The curable mechanical fastener may also further comprise the complementary fastening surface.

For example, a multi-part curable mechanical fastener comprises a first part comprising a fastening surface and a second part comprising a complementary fastening surface that complements the fastening surface. At least one of the fastening surface and the complementary fastening surface is at least partially fabricated from a curable material, such that when the fastening surface is mechanically attached to the complementary fastening surface, the multi-part curable mechanical fastener is capable of being cured to provide a permanent fastener.

Advantageously, the curable mechanical fastener may remain reclosable for at least one hour after fabrication. Preferably, the curable mechanical fastener is reclosable for at least one month after fabrication. Thus, the curable mechanical fasteners can be repeatedly fastened and unfastened for relatively long periods of time prior to forming a permanent fastener therefrom.

Preferably, the complementary fastening surface also comprises a curable material. The curable material may comprise a single component. For example, in one embodiment, the curable material comprises a functionalized-thermoplastic composition.

The curable material may alternatively comprise more than one component. For example, in another embodiment, the curable material comprises a combination of at least one thermosettable composition and at least one thermoplastic composition. For example, the thermosettable composition may comprise at least one thermosettable material selected from the group consisting of (meth)acrylates, urethanes, vinyl ethers, epoxies, cyanates, esters, phenolics, polyimides, amine formaldehyde condensates, and mixtures thereof. Preferably, the thermosettable composition comprises an epoxy.

The thermoplastic composition may comprise at least one thermoplastic material selected from the group consisting of polyesters, polyolefins, polyamides, polyethers, polyurethanes, plasticized polyvinyl chloride, thermoplastic elastomer block copolymers, phenoxy resins, polyketones, silicones, polyetherimides, polycarbonates, polysulfones, polyoxides, and mixtures thereof. Preferably, the thermoplastic composition comprises a polyester, most preferably a polyester that is semi-crystalline at room temperature.

A particularly preferred embodiment of the curable material is a two-component curable material wherein the thermosettable composition comprises an epoxy and the thermoplastic composition comprises a polyester.

The fastening surface can be any suitable shape. For example, the fastening surface may comprise a plurality of fastening elements coupled to a backing. The fastening elements may also be any suitable shape. For example, in one preferred embodiment, at least one fastening element is mushroom-shaped.

The fastening surface can be formed using any suitable method. For example, the fastening surface can be formed using a method selected from the group consisting of extruding, melt-blowing, molding, and microreplicating.

Based on the shape (i.e., surface topography) of the fastening surface and the complementary fastening surface, the curable mechanical fastener may be of a wide variety of types. For example, the curable mechanical fastener may be a hook-and-loop mechanical fastener. In another embodiment, the fastening surface comprises protruding fastening elements and the complementary fastening surface comprises recessed structures.

The curable mechanical fasteners are capable of being cured to provide cured mechanical fasteners (i.e., permanent fasteners). Structural or semi-structural bonds may be formed using certain curable mechanical fasteners of the invention. For example, the cured mechanical fastener may have an overlap shear strength of at least about 0.07 MPa or even at least about 7 MPa.

Any suitable curing method can be used to form the permanent fastener. The method used typically depends on the chemistry of the curable material. Methods of curing the curable materials vary widely and are known to those of ordinary skill in the art. In one preferred embodiment, the curable mechanical fastener is cured using actinic radiation. An optional heating step may be used to further cure the curable mechanical fastener.

A method of forming a permanent fastener comprises the steps of: providing a curable mechanical fastener, attaching the fastening surface to the complementary fastening surface, and curing the mechanical fastener to provide a permanent fastener. The method can further comprise the step of attaching the curable mechanical fastener to a substrate. For example, the curable mechanical fastener can be permanently attached to the substrate. Similarly, a curable mechanical fastener comprising the complementary fastening surface can be permanently attached to a substrate.

DETAILED DESCRIPTION OF THE PREFERRED EMBODIMENTS

Figure 1A:
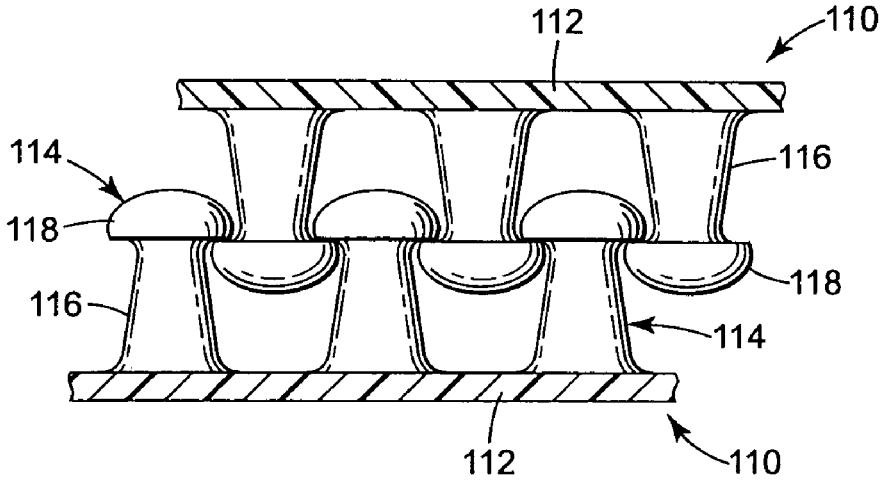
FIG. 1A is a cross-sectional representation of a mushroom-shaped curable mechanical fastener of the present invention.

Advantageously, curable mechanical fasteners of the present invention are capable of being converted from "reclosable" curable mechanical fasteners to "permanent" fasteners. Fasteners are described herein with reference to direction of applied force. For example, a fastener may be "fastened" with respect to a shear force (e.g., gravity) applied in one direction, but may not withstand a shear force exerted in a another (e.g., perpendicular) direction. As long as fastening of an article is achieved with reference to one direction of applied force, the article is a fastener for purposes of this invention. Preferably, however, curable mechanical fasteners of the invention remain fastened when force is applied in any direction.

"Reclosable" curable mechanical fasteners are those that are capable of being easily fastened and unfastened repeatedly without the use of artificial mechanical aids. That is, reclosable curable mechanical fasteners can be easily fastened and unfastened by an ordinary person, without the need for artificial mechanical aids, such as mechanical tools (e.g., hammers, crowbars, wrenches, and the like).

Preferably, the reclosable curable mechanical fasteners can be fastened and unfastened a multitude of times. Those fasteners that cannot be fastened and unfastened, preferably achieving the same fastening strength each time, at least five times lack the structural integrity of preferred reclosable curable mechanical fasteners of the present invention.

Reclosability of mechanical fasteners of the invention is not significantly affected during the shelf life of the materials from which they are fabricated. Preferably, upon fabrication, reclosable curable mechanical fasteners of the invention maintain their reclosability for at least one hour, more typically at least several days, weeks, or months until cured to provide a permanent fastener.

"Permanent" fasteners, in contrast to reclosable curable mechanical fasteners, are those that cannot be easily unfastened without the use of artificial mechanical, physical, and/or chemical aids and without destroying the fastener (i.e., preventing the fastener's reclosure in substantially the same manner). That is, an ordinary person typically cannot unfasten a permanent fastener, except by using artificial mechanical, physical, and/or chemical aids (e.g., hammers, crowbars, wrenches, solvent, heat, and the like). Or, if the permanent fastener can be unfastened, the fastener is destroyed (i.e., the fastener cannot be fastened in substantially the same manner).

In many cases, the permanent fasteners are "semi-structural" or "structural" fasteners. "Semi-structural" fasteners are those that have an overlap shear strength of at least about 0.7 megaPascals (MPa). For use where even higher fastening strength is desired or necessary, "structural" fasteners of the present invention have an overlap shear strength of at least about 3.5 MPa, more preferably at least about 5 MPa, and even more preferably at least about 7 MPa.

The present invention is directed toward curable mechanical fasteners that can be cured to provide permanent fasteners. "Curable" mechanical fasteners are those that are at least partially fabricated from a material (i.e., "curable material") that becomes substantially infusible and chemically inert when exposed to an activation source that crosslinks (i.e., "cures") the material.

Each curable mechanical fastener comprises at least one fastening surface. The fastening surface is capable of being fastened to a complementary fastening surface. That is, the "fastening surface" is that portion of the curable mechanical fastener that complements another fastening surface in a mechanical manner when engaged to provide a mechanical attachment. When present, a "complementary fastening surface" is that portion of the curable mechanical fastener that receives a fastening surface in a mechanical manner to provide a mechanical attachment. At least one of, preferably both of, the fastening surface and the complementary fastening surface is at least partially fabricated from a curable material.

Fastening Surfaces

The surface topography of each fastening surface and its complementary fastening surface is not critical to the invention and can vary widely. A fastening surface is merely capable of reclosably attaching to a complementary fastening surface to provide a mechanical attachment prior to curing of the curable material. Upon curing, the surface topography allows for formation of a permanent attachment.

Those of ordinary skill in the art of mechanical fasteners know many surface topographies. Any suitable surface topographies may be used so long as the fastening surfaces are capable of forming a mechanical attachment that is reclosable prior to curing of the curable material. In certain embodiments, the fastening surfaces may be substantially the same in terms of surface topography.

In one embodiment, each mechanical fastener comprises a backing having a fastening surface on at least one side thereof. For example, the fastening surface may include a multitude of fastening elements that are coupled to a backing. Fastening elements of many shapes and sizes are known. For example, the fastening elements may take the shape of hooks, loops, mushrooms, balls on stems, pigtails, screws, threaded holes, bolts, nuts, zipper tracks, and a wide variety of other shapes.

In certain embodiments, at least two surfaces (e.g., opposite surfaces) of the backing comprise fastening surfaces. The surface topography of each fastening surface may be similar or different. Each fastening surface can be attached to another fastening surface to provide at least two points of mechanical attachment, wherein at least one point of mechanical attachment resides on each side of the backing.

The backing having the fastening surface may also comprise a complementary fastening surface. Thus, a single component (i.e., part) is capable of forming a mechanical attachment. More typically, the complementary fastening surface is present as a separate component. In those embodiments, at least two distinct components are needed to form the mechanical attachment.

Alternatively, the surface to be fastened may constitute the complementary fastening surface. This may be the case when, for example, a fastening surface comprising a plurality of hooks engages a fibrous material (e.g., burlap, terry cloth, or tricot substrate) to be fastened. In this embodiment, the fibrous material to be fastened is the complementary fastening surface.

Depending on the surface topographies of the fastening surfaces, the curable mechanical fasteners may be of a wide variety of types. In one embodiment, surface topography of the fastening surfaces is that of hook-and-loop mechanical fasteners. Examples of these fasteners include those sold under the trade name VELCRO (available from Velcro USA, Inc. of Manchester, N.H.) and those sold under the SCOTCHMATE trade designation (available from Minnesota Mining and Manufacturing Co. of St. Paul, Minn.). In this embodiment, the fastening surface of the hook-and-loop mechanical fastener comprises a plurality of hooks and its complementary fastening surface comprises a plurality of loops.

Many known surface topographies and variations thereof can be used for curable mechanical fasteners of the invention. For example, U.S. Pat. No. 5,077,870 (Melbye et al.) discloses mushroom-type surface topographies for use in hook-and-loop mechanical fasteners. As shown in FIG. 1A, each fastening surface 110 (i.e., hook strip) of the mechanical fasteners therein comprises a flexible backing 112 of thermoplastic resin and, on one side of the backing 112, an array of upstanding fastening elements 114 (i.e., hooks) distributed across at least one face of the backing 112, each fastening element 114 comprising an upstanding stem 116 with a mushroom-shaped head 118. The mushroom-type fastening surfaces 110 can be produced, for example, by injecting resin into cavities of a cylindrical mold while evacuating and cooling the cavities so that the cooled resin becomes molecularly oriented.

In one embodiment, as shown in FIG. 1A, the mechanical fastener is configured such that two pieces of hook strip 110 are engaged to form a hermaphroditic-type mechanical fastener, one of the hook strips functioning as a fastening surface, the other hook strip functioning as its complementary fastening surface. However, in other embodiments, a single hook strip 110 may function as a fastening surface that can be reclosably attached to a fabric or loop strip that is penetrable by the fastening elements 114, such that the fabric or loop strip functions as a complementary fastening surface.

Figure 1B:
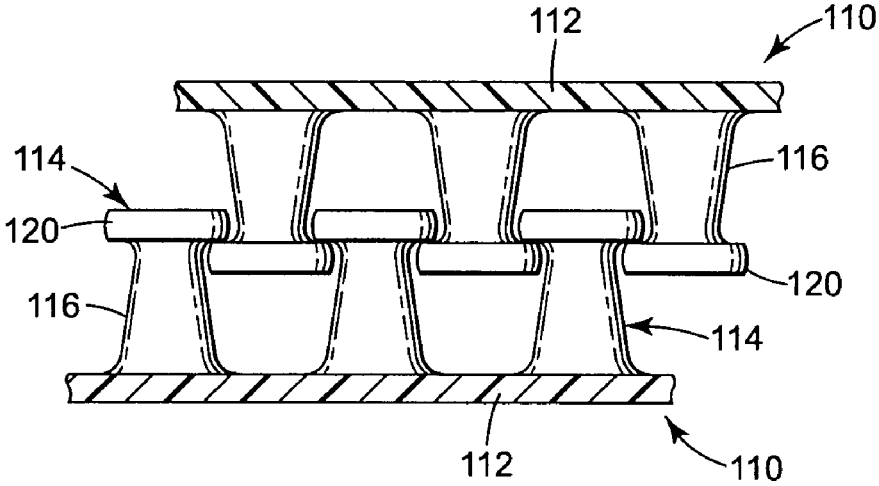
FIG. 1B is a cross-sectional representation of a modified mushroom-shaped curable mechanical fastener of the present invention.

Further variations on mushroom-type surface topographies are also known. See, for example, U.S. Pat. No. 5,679,302 (Miller et al.), where methods for formation of mushroom-type surface topographies are described. As shown in FIG. 1B, the stems 116 include circular disc-shaped heads 120 at the ends of the 116 stems opposite the backing 212. The heads 120 may alternatively have one of a wide variety of other shapes, such as rectangles or hexagons.

Figure 2:
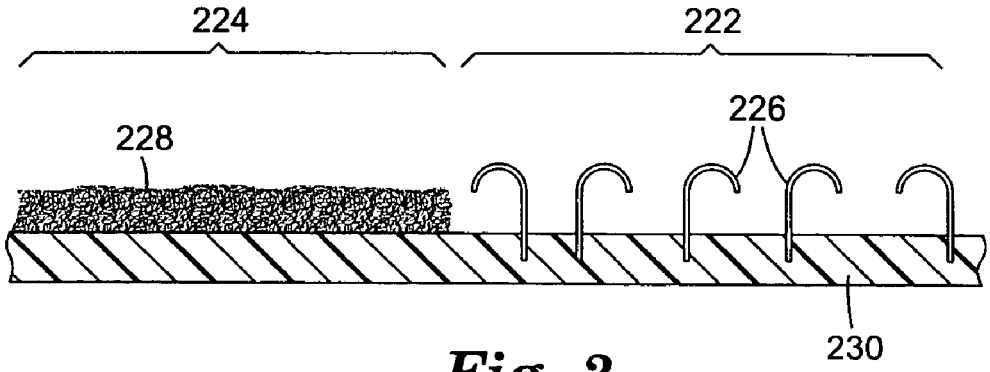
FIG. 2 is a cross-sectional representation of a hook-and-loop curable mechanical fastener of the present invention.

More conventional hook-and-loop type fastening surface topographies are illustrated in FIG. 2. In this embodiment, the fastening surface 222 and its complementary fastening surface 224 are integrated into a single component. That is, the fastening elements 226 and 228 comprising the respective fastening surface 222 and complementary fastening surface 224 are coupled to a single backing 230.

Dimensions of the hooks and loops on fastening surfaces of such curable mechanical fasteners can also vary widely. Dimensions will not be described in detail here because it is generally well known how to fabricate mechanical fasteners and any suitable mechanical fastener configuration can be used in the present invention.

Many suitable surface topographies for complementary fastening surfaces include those where one fastening surface includes protruding fastening elements, while its complementary fastening surface includes recessed structures that serve as fastening elements. Many such topographies are capable of providing curable mechanical fasteners having fastening surfaces according to the present invention.

Figure 3:
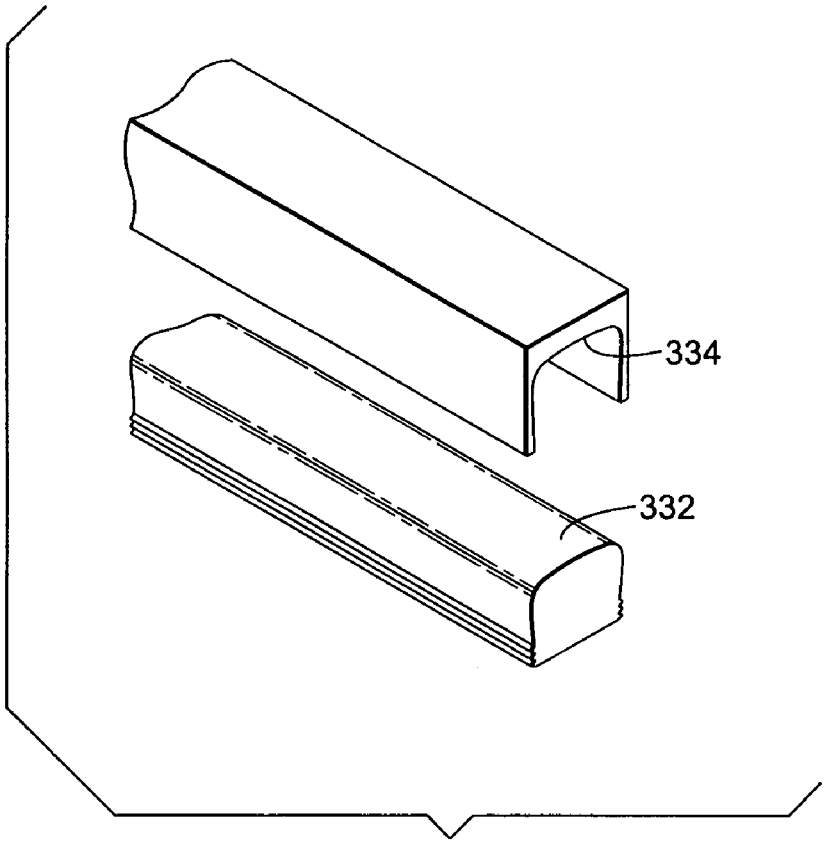
FIG. 3 is a three-dimensional representation of a tongue-and-groove curable mechanical fastener of the present invention.

For example, complementary fastening surfaces may have respective tongue and groove topographies. Such mechanical fasteners have found widespread use in the packaging industry and are sold in plastic products available under the trade designation ZIPLOC (available from SC Johnson Wax of Racine, Wis.). As shown in FIG. 3, a tongue-shaped fastening surface 332 is capable of being engaged with a groove-shaped fastening surface 334 to provide a curable mechanical fastener.

Figure 4:
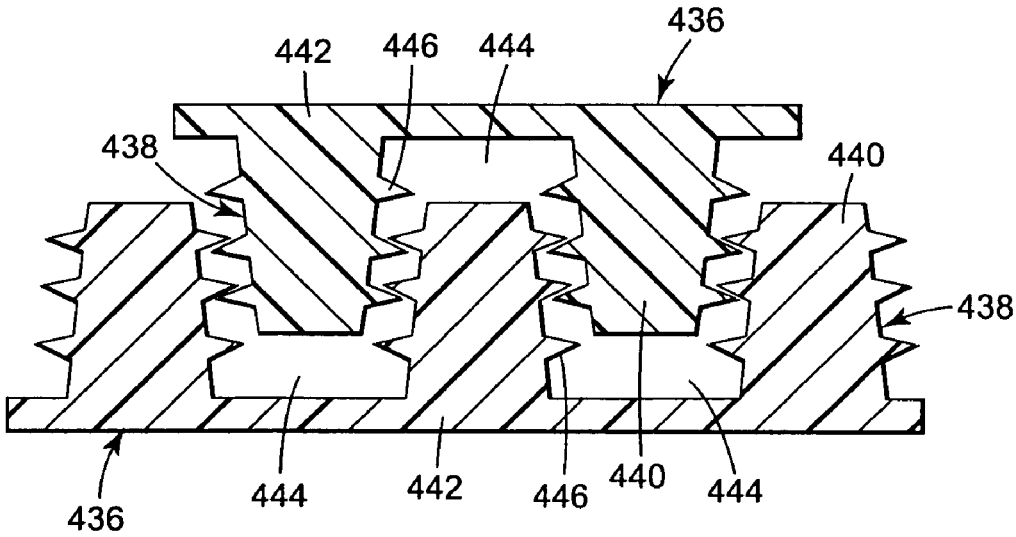
FIG. 4 is a cross-sectional representation of a curable mechanical fastener, wherein the fastening surface comprise a plurality of protrusions and recesses.

Also see U.S. Pat. No. 5,657,516 (Berg et al.), where other mechanical fastener surface topographies are described. Two such mechanical fasteners 436 are shown in FIG. 4. As shown in FIG. 4, each mechanical fastener 436 includes a fastening surface 438 comprising a series of protrusions 440 projecting from a backing 442 with a series of recesses 444 therebetween. Each of the protrusions 440 and recesses 444 has a textured surface formed from microprotrusions 446 to enhance mechanical engagement of the fastening surface 438 with a complementary fastening surface. The fastening surface 438 of the mechanical fastener 436 can be fastened to a similar surface 438 of another mechanical fastener 436, as contemplated in FIG. 4, or it can be fastened to another suitable complementary fastening surface. When the two mechanical fasteners shown in FIG. 4 are fastened, one of the surfaces 438 functions as an fastening surface and the other surface 438 functions as its complementary fastening surface. When used as a pair, the two individual mechanical fasteners can also be referred to as a single mechanical fastener.

Figure 5:
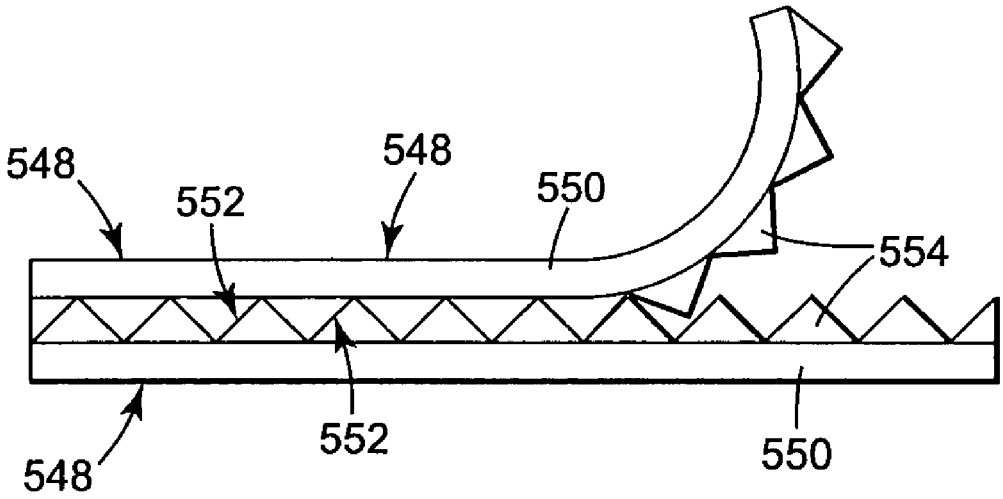
FIG. 5 is a cross-sectional representation of a curable mechanical fastener, wherein the fastening surface comprises a plurality of tapered elements.

In another embodiment, surface topographies of the fastening surfaces may be similar to those described in U.S. Pat. No. 5,196,266 (Lu et al.). Two such mechanical fasteners 548 are shown in FIG. 5. As shown in FIG. 5, each mechanical fastener 548 comprises a backing 550 having a fastening surface 552 comprising a plurality of tapered fastening elements 554. The fastening surface 552 of each mechanical fastener 548 can be fastened to a similar surface 552 of another mechanical fastener 548, as shown in FIG. 5, or it can be fastened to another suitable complementary fastening surface. When the two mechanical fasteners shown in FIG. 5 are fastened, one of the surfaces 552 functions as a fastening surface and the other surface 552 functions as its complementary fastening surface. When used as a pair, the two individual mechanical fasteners 548 can also be referred to as a single mechanical fastener.

Each fastening surface, including any fastening elements present, are typically fabricated from one layer of material. In fact, due to processing efficiency, it is preferred that the fastening surface and engaging surface be fabricated from only one layer of material. Furthermore, for simplicity, preferably both the fastening surface and its complementary fastening surface are fabricated from only one layer of material.

In further embodiments, the fastening surface surface may be fabricated from a multitude of layers, wherein each layer may comprise a different material. In these embodiments, the composition and topography of interior layers is generally not critical. It is desired, however, that the interior layers be able to withstand any curing conditions used to transform the curable mechanical fastener into a permanent fastener. The exterior layer or one of the outermost layers, however, of at least one of the fastening surface and its complementary fastening surface is at least partially fabricated from a curable material, as described below. In these embodiments, a preferred curing method may be moisture curing or surface activation.

For example, an interior layer of the fastening surface may be fabricated from any conventional material used in fabricating mechanical fasteners. Such materials include glass, ceramic, metal, wood, non-thermosettable thermoplastic resins (e.g., polyamides, polyesters, polyolefins, or polyvinyl chloride). The exterior layer or one of the outermost layers, however, is fabricated from a curable material such that the curable mechanical fastener can be cured to provide a permanent fastener. The thickness and surface topography of the exterior layer need only be such that the desired strength is achieved in the permanent fastener.

In any case, at least one of the fastening surface and its complementary fastening surface is at least partially fabricated from a curable material. Preferably, each of the fastening surfaces is at least partially fabricated from a curable material. Most preferably, each of the fastening surfaces is completely fabricated from a curable material. Again, the curable material used for each of the fastening surfaces need not be the same material, but it is preferred that they are the same material for simplicity of production and use.

Curable Material

Curable materials according to the present invention are those that cure only upon exposure to an external source, such as thermal radiation, actinic (e.g., ultraviolet) radiation, moisture (i.e., as in moisture curing), or organic chemicals (e.g., as in surface activation). At least one of the fastening surfaces comprises a curable material. That is, the curable material is not merely an additive (e.g., curable adhesive) that is applied as a separate component in a mechanical fastener system at or near the time that fastening is desired. Advantageously, the curable material is an integral part of the curable mechanical fasteners of the invention.

The curable material is melt-fusible at the curing temperature of the material to provide permanent melt-fused bonds when cured. However, it is preferred that the curable material also maintains its structural integrity upon curing. Thus, preferably, melt-fusion is controlled and limited to that needed to form a permanent melt-fused bond.

"Melt-fusible" as used herein does not necessarily mean macroscopic melt-flow. In melt-fusible materials, melt-flow may only occur on a microscopic level. As long as the material develops an adhesive bond to the mechanically attached surface, the material is sufficiently melt-fusible.

Preferably, the curable material is non-tacky prior to curing. Non-tacky surfaces facilitate reclosability and help minimize accumulation of residue on the fastening surface(s) of the curable mechanical fastener.

A "thermosettable" or "thermosetting" composition is one which can be cured (i.e., crosslinked), for example by exposure to, preferably, thermal radiation (although exposure to actinic radiation, moisture, or other means may also suffice), to yield a substantially infusible (i.e., thermoset) material. Combinations of various curing means may also be used (e.g., a combination of heat and actinic radiation).

A "thermoplastic" composition is one that is capable of being repeatedly softened by heat and hardened by cooling. Certain thermoplastic compositions may also be thermosettable. For example, functionalized-thermoplastic compositions are thermosettable thermoplastics. These materials are further described below.

The curable material is typically a combination of a thermoplastic composition and a thermosettable composition. It is preferred that components of the curable material are compatible. That is, during melt mixing of the components, a substantially homogenous, single-phase system is formed, as evidenced by a lack of macroscopic phase separation to the unaided human eye.

Curable materials of the present inventions are both thermosettable and melt-fusible, whether they comprise one component (e.g., a single polymer) or a combination of components (e.g., two or more polymers). For example, functionalized-thermoplastic compositions comprising essentially a single component (i.e., polymer) may be selected such that they are both thermosettable and melt-fusible.

Functionalized-thermoplastic Compositions

A wide variety of functionalized-thermoplastic compositions are known. Many of these compositions are copolymers. Such copolymers are typically formed by copolymerizing monomers from a first group, homopolymers of which are thermoplastic compositions, and monomers from a second group, homopolymers of which are thermosettable compositions.

For example, the first group of monomers includes vinyl monomers, such as α-olefin monomers (e.g., ethylene, propylene, octene, etc.), (meth)acrylate (i.e., methacrylate or acrylate) monomers (e.g., butyl acrylate, ethyl methacrylate, acrylic acid, etc.), vinyl ester monomers (e.g., vinyl acetate and derivatives thereof), vinyl alkyl ethers (e.g., vinyl methyl ether, vinyl ethyl ether, vinyl n-butyl ether, vinyl 2-chloroethyl ether, vinyl isobutyl ether, vinyl phenyl ether and vinyl 2-ethylhexyl ether), vinyl ethers of substituted aliphatic alcohols (e.g., 1,4-di(ethenoxy)butane and vinyl 4-hydroxybutyl ether), N-vinyl compounds (e.g., N-vinyl-N-methyl octanesulfonamide and N-vinylpyrrolidone), and combinations thereof. A description of vinyl monomers and their use in preparing polymers is set forth in "Vinyl and Related Polymers," by Schildknecht, published by John Wiley & Sons, Inc., New York (1952).

The second group of monomers includes monomers that are copolymerizable with the monomers of the first group, and include, for example, glycidyl acrylate, allyl glycidyl ether, 2-isocyanatoethyl acrylate, and combinations thereof.

Other functionalized-thermoplastic compositions include those where a thermoplastic polymer chain is end-capped with moieties containing functional groups that are thermosettable. The moieties containing thermosettable functional groups may alternatively be present as pendant functional groups along the main polymer chain. U.S. Pat. No. 4,356,050 describes functionalized-thermoplastic compounds, including epoxy-siloxane polymers, epoxy-polyurethanes, and epoxy-polyesters. Also see U.S. Pat. Nos. 4,287,113; 5,332,783; 5,366,846; 5,837,749; and 5,723,191 for further descriptions of functionalized-thermoplastic compositions.

Functionalized-thermoplastic compositions may be prepared, for example, by functionalization of polymers such as, for example, acrylic acid copolymers that have been reacted with polyfunctional epoxy resins to give epoxy-functional thermoplastic compositions.

Thermosettable Composition

Any suitable thermosettable composition may be used. For example, (meth)acrylate, epoxy, urethane, cyanate (e.g., isocyanates, including blocked isocyanates, such as isocyanate groups blocked with an oxime or a phenol following the procedures described in Z. W. Wicks, Jr., "Blocked Isocyanates," *Progress in Organic Coatings, vol.* 3 (1975), pp. 73–99); ester (e.g., cyanate ester), ether (e.g., vinyl ether), amine formaldehyde condensate, phenolic, and polyimide chemical compositions and mixtures thereof may provide the thermosettable composition.

Particularly preferred are epoxy-containing thermosettable compositions. Useful epoxy-containing materials are epoxy resins that have at least one oxirane ring polymerizable by a ring opening reaction. Such materials, broadly called epoxides, include both monomeric and polymeric epoxides and can be aliphatic, cycloaliphatic or aromatic. These materials generally have, on the average, at least two epoxy groups per molecule (preferably more than two epoxy groups per molecule). The "average" number of epoxy groups per molecule is defined as the number of epoxy groups in the epoxy-containing material divided by the total number of epoxy molecules present. The polymeric epoxides include linear polymers having terminal epoxy groups (e.g., a diglycidyl ether of a polyoxyalkylene glycol), polymers having skeletal oxirane units (e.g., polybutadiene polyepoxide), and polymers having pendent epoxy groups (e.g., a glycidyl methacrylate polymer or copolymer). The molecular weight of the epoxy-containing material may vary from about 58 to about 100,000 or more. Mixtures of various epoxy-containing materials can also be used.

Particularly useful epoxy-containing materials include those that contain cyclohexene oxide groups such as the epoxycyclohexanecarboxylates, typified by 3,4-epoxycyclohexylmethyl-3,4-epoxycyclohexanecarboxylate, 3,4-epoxy-2-methylcyclohexylmethyl-3,4-epoxy-2-methylcyclohexanecarboxylate, and bis(3,4-epoxy-6-methylcyclohexylmethyl) adipate. For a more detailed list of useful epoxides of this nature, reference is made to U.S. Pat. No. 3,117,099.

Further epoxy-containing materials that are particularly useful include glycidyl ether monomers, such as glycidyl ethers of polyhydric phenols, which are obtainable by reacting a polyhydric phenol with an excess of a chlorohydrin, such as epichlorohydrin (e.g., the diglycidyl ether of 2,2-bis-(2,3-epoxypropoxyphenol)propane). Further examples of epoxides of this type are described in U.S. Pat. No. 3,018,262. Other useful glycidyl ether based epoxy-containing materials are described in U.S. Pat. No. 5,407,978.

There are a number of commercially available epoxy-containing materials that can be used. In particular, epoxides that are readily available include the following chemistries: octadecylene oxide; epichlorohydrin; styrene oxide; vinylcyclohexene oxide; glycidol; glycidyl methacrylate; diglycidyl ether of BISPHENOL A (e.g., those available under the trade designations EPON SU-8, EPON SU-2.5, EPON 828, EPON 1004F, and EPON 1001F from Shell Chemical Co. of Houston, Tex., and DER-332 and DER-334 from Dow Chemical Co. of Midland, Mich.); diglycidyl ether of Bisphenol F (e.g., ARALDITE GY281 from Ciba-Geigy Corp. of Ardsley, N.Y.); vinylcyclohexene dioxide (e.g., ERL 4206 from Union Carbide Corp. of Danbury, Conn.); 3,4-epoxycyclohexylmethyl-3,4-epoxycyclohexene carboxylate (e.g., ERL-4221 from Union Carbide Corp.); 2-(3,4-epoxycylohexyl-5,5-spiro-3,4-epoxy)cyclohexane-metadioxane (e.g., ERL-4234 from Union Carbide Corp.); bis(3,4-epoxycyclohexyl) adipate (e.g., ERL-4299 from Union Carbide Corp.); dipentene dioxide (e.g., ERL-4269 from Union Carbide Corp.); epoxidized polybutadiene (e.g., OXIRON 2001 from FMC Corp. of Chicago, Ill.); epoxysilane (e.g., beta-(3,4-epoxycyclohexyl)ethyltrimethoxysilane and gamma-glycidoxypropyltrimethoxysilane from Union Carbide Corp.), flame retardant epoxy (e.g., DER-542, a brominated Bisphenol-type epoxy resin available from Dow Chemical Co.); 1,4-butanediol diglycidyl ether (e.g., ARALDITE RD-2 from Ciba-Geigy Corp.); hydrogenated Bisphenol A-epichlorohydrin-based epoxy (e.g., EPONEX 1510 from Shell Chemical Co.); and polyglycidyl ether of phenol-formaldehyde novolak (e.g., DEN-431 and DEN-438 from Dow Chemical Co.).

Other thermosettable compositions useful for the curable material include, for example, urethane-based compositions. Such compositions are often derived from one or more polyisocyanates (e.g., diisocyanates, such as 4,4'-diphenylmethylene diisocyanate, toluene diisocyanate, isophorone diisocyanate, or hexamethylene diisocyanate, or derivatives thereof).

Thermoplastic Composition

Any suitable thermoplastic composition may be used. Preferably, thermoplastic compositions used in the curable material are provided as substantially homogenous, single-phase materials that do not include a dispersed phase, such as crosslinked particles. Also, thermoplastic compositions selected for the curable material preferably display a softening temperature (as measured by a ring and ball softening test) that is greater than the service temperature of the ultimate construction into which the curable mechanical fastener will be incorporated. The service temperature of the ultimate construction refers to the maximum temperature that the ultimate construction is expected to be exposed to under ordinary use conditions.

Suitable thermoplastic compositions include polyesters (e.g., polycaprolactones), thermoplastic elastomer block copolymers (e.g., styrene-acrylonitrile-, styrene-butadiene-acrylonitrile-, styrene-butadiene- or styrene-isoprene-based block copolymers), phenoxy resins, polyurethanes, polyketones (e.g., poly(ether) ketone), polyolefins (e.g., polypropylene and polypropylene-polyethylene copolymers), silicones, plasticized polyvinyl chloride, polyetherimides, polycarbonates, polysulfones, polyoxides, polyamides, and mixtures thereof.

Particularly preferred thermoplastic compositions are polyester compositions. The polyester compositions may also include other functional groups. Other functional groups that may be present in the polyester compositions include, for example, —NH—, —CONH—, —$NH_2$, —SH, anhydride, urethane, and oxirane groups.

Particularly preferred polyesters are solid at room temperature. Preferred polyester compositions also have a number average molecular weight of about 7,500 to about 200,000, more preferably from about 10,000 to about 50,000, and most preferably, from about 15,000 to about 30,000.

Preferred polyester compositions are hydroxyl-terminated and carboxyl-terminated polyesters that may be amorphous or semi-crystalline, preferably semi-crystalline, at room temperature. A polymer that is "semi-crystalline" displays a crystalline melting point, as determined by differential scanning calorimetry (DSC), preferably with a maximum melting point of about 200° C. Crystallinity in a polymer is also observed as a clouding or opacifying upon cooling of a sheet that has been heated to an amorphous state. When the polymer is heated to a molten state and knife-coated onto a liner to form a sheet, it is amorphous and the sheet is observed to be clear and fairly transparent to light. As the polymer in the sheet material cools, crystalline domains form and the crystallization is characterized by the clouding of the sheet to a translucent or opaque state. The degree of crystallinity may be varied in the polymers by mixing-in any compatible combination of amorphous polymers and semi-crystalline polymers having varying degrees of crystallinity. The clouding of the sheet provides a convenient non-destructive method of determining that crystallization has occurred to some degree in the polymer.

A wide variety of polyesters (e.g., poly(butylene terephthalate), poly(ethylene terephthalate), poly(ethylene sebacate), poly(decamethylene adipate), poly(decamethylene sebacate), poly(pivalolactone), poly(α,α-dimethylpropiolactone), poly(α,α-diethyl-β-propiolactone), poly(para-hydroxybenzoate), poly(caprolactone), poly(ethylene oxybenzoate), and poly(6-azabicyclo[2.2.2]octane-5-one)) can be used as thermoplastic compositions of the invention.

Polyester components particularly useful in the invention comprise the reaction product of dicarboxylic acids (or their diester equivalents, including anhydrides) and diols. The diacids (or diester equivalents) can be saturated aliphatic diacids containing from about 4 to about 12 carbon atoms (including branched, unbranched, or cyclic materials having 5 to 6 carbon atoms in a ring) and/or aromatic diacids containing from about 8 to about 15 carbon atoms.

Examples of suitable aliphatic diacids include succinic; glutaric; adipic; pimelic; suberic; azelaic; sebacic; 1,12-dodecanedioic; 1,4-cyclohexanedicarboxylic; 1,3-cyclopentanedicarboxylic; 2-methylsuccinic; 2-methylpentanedioic; 3-methylhexanedioic acids; and the like. Suitable aromatic diacids include terephthalic; isophthalic, phthalic; 4,4'-benzophenonedicarboxylic; 4,4'-diphenylmethanedicarboxylic; 4,4'-diphenylthioetherdicarboxylic; 4,4'-diphenylaminedicarboxylic acids; and the like. Preferably, the structure between the two carboxyl groups in the diacids contains only carbon and hydrogen. More preferably, the structure between the two carboxyl groups in the diacids is a phenylene group. Blends of the foregoing diacids may also be used.

The diols include branched, unbranched, and cyclic aliphatic diols having from about 2 to about 12 carbon atoms. Examples of suitable diols include ethylene glycol; 1,3-propylene glycol; 1,2-propylene glycol; 1,4-butanediol; 1,3-butanediol; 1,5-pentanediol; 2-methyl-2,4-pentanediol; 1,6-hexanediol; cyclobutane-1,3-di(2'-ethanol); cyclohexane-1,4-dimethanol; 1,10-decanediol; 1,12-dodecanediol; and neopentyl glycol. Long chain diols including poly(oxyalkylene)glycols in which the alkylene group contains from about 2 to about 9 carbon atoms, preferably about 2 to about 4 carbon atoms, may also be used. Blends of the foregoing diols may also be used.

Useful commercially available hydroxyl-terminated polyester materials include various saturated linear, semi-crystalline copolyesters available from Creanova, Inc. of Somerset, N.J., such as those sold under the trade designations DYNAPOL S330, DYNAPOL S1401, DYNAPOL S1402, DYNAPOL S1358, DYNAPOL S1359, DYNAPOL S1227, and DYNAPOL S1229. Useful saturated, linear amorphous copolyesters available from Creanova, Inc. include those sold under the trade designations DYNAPOL S1313 and DYNAPOL S1430.

Preferably, the curable material comprises a blend of an epoxy-based thermosettable composition and a thermoplastic composition, most preferably a thermoplastic composition that is polyester-based. In general, this combination of components provides a thermosettable, melt-fusible curable material with compatible components. Examples of such blends are described, for example, in PCT Publication No. WO96/32453 to Johnson et al., entitled "Melt-Flowable Materials and Method of Sealing Surface."

Also see U.S. Ser. No. 09/070,971, filed on May 1, 1998, entitled "Epoxy/Thermoplastic Photocurable Adhesive Composition" and U.S. patent application Ser. No. 09/071,267, filed on May 1, 1998, entitled "Energy Cured Sealant Composition" for a discussion of epoxy-ethylene vinyl acetate curable materials.

Other useful two-component curable materials include epoxy-(meth)acrylate combinations, such as those described, for example, in Kitano et al. (U.S. Pat. No. 5,086,088). Epoxy-(meth)acrylate combinations are preferably the photopolymerized reaction product of a composition featuring (i) a prepolymeric (i.e., partially polymerized to a viscous syrup typically having a Brookfield viscosity between about 100 and 10,000 centipoise) or monomeric syrup of an acrylic or methacrylic acid ester; (ii) optionally, a reinforcing comonomer; (iii) an epoxy resin; (iv) a photoinitiator; and (v) a thermally activated curing agent for the epoxy. Suitable epoxy resins include those described above. Suitable thermally activated curing agents and photoinitiators are well known to those of ordinary skill in the art and are described further below.

Other two-component curable materials include epoxy resins blended with ethylene/acrylic acid or thermoplastic elastomers, such as block copolymers of arenyl materials (e.g., styrene) and elastomeric materials (e.g., isoprene, butadiene and their saturated counterparts). Other examples include combinations of (meth)acrylates and other thermosettable resins, such as urethane resins and phenolic resins. Another class of useful curable materials includes blends of ethylene vinyl acetate and elastomers, such as polybutadiene rubber. Commercially available examples of such compositions include those sold under the trade designations L-3034 sealant (available from L&L Products of Romeo, Mich.) and ORBSEAL 124.5 (available from Orbseal, Inc. of Excelsior Springs, Mo.).

In a multi-component curable material, the curable material typically includes from about 0.01 to about 95 parts by weight of the thermosettable composition and, correspondingly, from about 99.99 to about 5 parts by weight of the thermoplastic composition based on 100 parts total weight of the curable material. More preferably, the curable material includes from about 0.1 to about 80 parts by weight of the thermosettable composition and, correspondingly, from about 99.9 to about 20 parts by weight of the thermoplastic composition based on 100 parts total weight of the curable material. Most preferably, the curable material includes from about 0.5 to about 60 parts by weight of the thermosettable composition, and, correspondingly, from about 99.5 to about 40 parts by weight of the thermoplastic composition based on 100 parts total weight of the curable material.

Increasing amounts of the thermosettable composition relative to the thermoplastic composition generally result in curable materials having higher ultimate strengths and heat resistance, but lower flexibility and viscosity. Increasing amounts of the thermoplastic composition generally result in curable materials having lower ultimate strengths and heat resistance, but higher flexibility and viscosity. Thus, the relative amounts of these ingredients are balanced depending on the properties sought in the curable material and mechanical fasteners fabricated therefrom.

Additives

In addition to the thermoplastic and thermosettable compositions (or functionalized-thermoplastic compositions), the curable material may contain other components. For example, the curable material may contain nucleating agents, curatives, accelerators, or rheological modifiers (e.g., thixotropic agents). Optional hydroxyl-containing compositions may also be included in the curable materials. Such materials are particularly useful in tailoring the flexibility of the composition.

When using semi-crystalline thermoplastic materials, nucleating agents may be added to adjust the rate of crystallization at a given temperature, and thus processing time of the curable material. Useful nucleating agents include microcrystalline waxes. Petrolite Corp. of St. Louis, Mo., for example, sells a suitable wax under the trade designation UNILIN 700.

Curing agents may be added to effect curing of the thermosettable or functionalized-thermoplastic composition when necessary. The type of curing agent added depends upon the method of curing and chemistry of the thermosettable or functionalized-thermoplastic composition. For example, the curable material may be cured using actinic radiation, electron beam radiation, or thermal radiation. Preferably, the curable material is cured using actinic radiation.

Useful actinically activated curing agents include aromatic iodonium complex salts, aromatic sulfonium complex salts, and metallocene salts, and are described in, for example, U.S. Pat. No. 5,089,536 (Palazzotto). Peroxides and oxalate esters can be used with the metallocene salts to increase the cure speed, as described in U.S. Pat. No. 5,252,694 (Willett). Useful commercially available actinically activated curing agents include those available under the trade designations, FX-512 (an aromatic sulfonium complex salt sold by Minnesota Mining & Manufacturing Company; St. Paul, Minn.), CD-1010 (an aromatic sulfonium complex salt available from Sartomer Co.; Exton, Pa.), CD-1012 (a diaryliodonium complex salt from Sartomer Co., UVI-6974 (an aromatic sulfonium complex salt available from Union Carbide Corp. of Danbury, Conn.), and IRGACURE 261 (a metallocene complex salt available from Ciba-Geigy Corp. of Ardsley, N.Y.).

Photosensitizers may also be included, for example, to enhance the efficiency of the actinically activated curing agent and/or to adjust the wavelength of photoactivity. Examples of photosensitizers include pyrene, fluoroanthrene, benzil, chrysene, p-terphenyl, acenaphthene, phenanthrene, biphenyl and camphorquinone.

A variety of thermally activated curing agents may also be used. For example, useful thermally activated curing agents include amine-, amide-, Lewis acid complex-, and anhydride-type materials. Those that are preferred include dicyandiamide, imidazoles and polyamine salts. These are available from a variety of sources, for example, under the trade designations OMICURE (available from Aceto Corporation; New Hyde Park, N.Y.), AJICURE (available from Ajinomoto Chemical of Teaneck, N.J.), and CUREZOL (available from Air Products Co. of Allentown, Pa.).

If used, it is preferred that the thermally activated curing agent does not activate curing during fabrication of the curable mechanical fastener. Thus, the thermally activated curative should be selected such that the curable material essentially does not cure at a temperature equal to or less than those temperatures used in fabricating the curable mechanical fastener. Accordingly, preferably, the curing temperature is at least about 120° C., more preferably at least about 150° C., and most preferably at least about 170° C.

Accelerators may be added to the curable material to more fully cure the material at a lower temperature or to shorten cure time of the curable material when exposed to heat. For example, imidazoles are useful accelerators, examples of which include: 2,4-diamino-6-(2'-methylimidazoyl)-ethyl-s-triazine isocyanurate; 2-phenyl-4-benzyl-5-hydroxymethylimidazole; and Ni-imidazole-phthalate.

One or more thixotropic agents may be used in an effective amount (i.e., an amount necessary to achieve the desired rheological properties of the curable material during the melt fusion stage of curing). In general, if used, the total amount of thixotropic agents is no greater than about 20% by weight, preferably no greater than about 10% by weight, more preferably no greater than about 5% by weight, and most preferably in the range of about 3–5% by weight based upon the total weight of the curable material.

Suitable thixotropic agents do not substantially interfere with cure, in the case of thermosetting compositions, or otherwise cause degradation of the composition. Representative examples of thixotropic agents include particulate fillers, beads (which may be, for example, of the glass, ceramic or polymeric type), bubbles (which may be, for example, of the glass, ceramic or polymeric type), and chopped fibers, as well as combinations thereof. Suitable particulate fillers include, e.g., hydrophobic and hydrophilic silica, calcium carbonate, titania, bentonite, clays and combinations thereof. Suitable fibers include polymeric fibers (e.g., aromatic polyamide, polyethylene, polyester and polyimide fibers), glass fibers, graphite fibers, and ceramic fibers (e.g., boron fibers).

Other materials that can be incorporated into the curable material include, for example, stabilizers, antioxidants, plasticizers, tackifiers, adhesion promoters (e.g., silanes, glycidyl methacrylate, and titanates), colorants, pigments, polymeric additives (e.g., polyacetals, reinforcing copolymers, and polycaprolactone diols) and the like.

The curable material is prepared by mixing the various ingredients in a suitable vessel, preferably one that is not transparent to actinic radiation, at an elevated temperature sufficient to soften the components so that they can be efficiently mixed with stirring until the components are thoroughly melt-blended but without thermally degrading the materials. The components may be added simultaneously or sequentially, although it is preferred to first blend the thermosettable composition and the thermoplastic composition followed by the addition of additives, such as a curing agent.

The curable material may be formed into fastening surfaces by any suitable method. For example, the curable material may be melt-blown, molded (e.g., injection-molded), extruded, or microreplicated into the desired shapes to provide fastening surfaces of curable mechanical fasteners of the invention. Any suitable method or variation of those mentioned above can be used. The method of fabricating the fastening surface may depend on the desired surface topography of the fastening surface.

When the curable mechanical fastener is formed by molding, it may be preferred to utilize a mold that is at least partially water-soluble for ease of removal after the curable mechanical fastener is formed. Water-soluble molds are known to those of ordinary skill in the art and include those described in, for example, PCT Publication No. WO95/07,170 and U.S. Pat. No. 5,242,646 to Torigoe et al.

Depending on the number of fastening elements comprising a respective surface, a backing may not be necessary. Preferably, however, at least one of the fastening surfaces comprises a plurality of fastening elements coupled to a backing.

Backing

Any suitable backing can be used. The backing is typically selected such that it provides the necessary strength and flexibility for the desired application. Preferably the backing has a sufficient strength to resist being significantly destroyed when unfastening the reclosable curable mechanical fastener prior to curing.

The type of backing selected may depend on the topography of the fastening surface. For example, when molded mushroom-type fasteners are used, the backing may be fabricated from a thermoplastic resin.

Usually, for a good combination of flexibility and strength, preferred backings having a thickness of from about 50 micrometers to about 1 millimeter thick, more preferably from about 130 micrometers to about 0.5 millimeter thick.

Attachment of Curable Mechanical Fastener to Substrate

The fastening surface or backing, if present, is typically attached to a substrate to be fastened. The fastening surface or backing may be attached to the substrate using any suitable attachment means. For example, the fastening surface or backing may be mechanically attached to a substrate, either permanently (such as by using a curable mechanical fastener of the present invention) or reclosably. Alternatively, the fastening surface or backing may be chemically attached to a substrate.

When permanently attaching the fastening surface or backing to a substrate, it may be, for example, bolted, heat-sealed (e.g., by dielectric heat sealing), riveted, sewn, stapled, welded (e.g., ultrasonically welded), or otherwise permanently attached to the substrate.

When chemically attaching the fastening surface or backing to a substrate, it may be, for example, coated with an adhesive and then adhered to the substrate. Another example of a chemical attachment means is by heat or solvent activation.

Any suitable adhesive may be used. Included in the multitude of suitable adhesives are pressure-sensitive-adhesives and structural adhesives. Preferably, when an adhesive is employed, the adhesive bond has a greater strength than the strength of the resultant permanent fastener bond. One specific adhesive that may provide structural bonding to a wide variety of surfaces is sold under the trade designation VHB tape and is available from Minnesota Mining & Manufacturing Co. of St. Paul, Minn. Another adhesive that may be used is 3M STRUCTURAL BONDING TAPE 9245 available from available from Minnesota Mining and Manufacturing Company of St. Paul, Minn.

Substrate

The substrate can be any type of material or object, the exact nature of which depends on the application. Surfaces to be fastened may be fabricated from the same material or they may be fabricated from different materials. For example, a fastening surface comprising a plurality of hooks fabricated from a thermoplastic resin is capable of reclosably attaching to a complementary fastening surface comprising a plurality of loops and fabricated from a wide variety of materials. For example, fibrous materials, such as burlap, terry cloth, and tricot may be mechanically fastened with a mechanical fastener consisting of fastening surface comprising a plurality of hooks.

Curing

The curable mechanical fastener can be cured to provide a permanent fastener, when desired. For example, the curable mechanical fastener may be repeatably attached and unattached to find the best attachment position, and then cured to provide a permanent attachment. Cure conditions are dependent on the chemistry employed and are known to those of skill in the art. Any suitable curing method can be used. For example, thermal or actinic radiation may be used to cure the curable material.

Advantageously, the cured mechanical fastener has both structural integrity (i.e., preferably, the initial surface topography is essentially present on fastening surfaces of the present invention after curing) and a permanent melt-fused bond. In certain embodiments, the melt-fused bond provides a fastener having semi-structural or structural strength.

The curable mechanical fasteners described herein are exemplified in the following examples. These examples are merely for illustrative purposes only and are not meant to be limiting on the scope of the appended claims. All parts, percentages, ratios, etc. in the examples and the rest of the specification are by weight unless indicated otherwise.

EXAMPLES

Example 1

This example demonstrates the preparation of a curable thermoplastic composition suitable for fabricating into a curable mechanical fastener.

Pellets were formed by blending 70 parts by weight of a hydroxyl-functional, semi-crystalline polyester (containing 50 weight % butanediol, 23 weight % terephthalic acid, and 27 weight % sebacic acid, with a melting point of 116° C., a glass transition temperature of −40° C., and a melt flow rate at 160° C. of 250 grams/10 minutes, obtained as DYNAPOL X1158 from Creanova, Inc.; Somerset, N.J.), 28 parts by weight of a BISPHENOL A end-capped aliphatic epoxy resin, as described in Example 1 of U.S. Pat. No. 5,407,978 (Bymark et al.), 1 part by weight UNILIN 700 microcrystalline wax (obtainable from Petrolite Corp. of St. Louis, Mo.), and 1 part by weight Cp(Xylenes)$Fe^{+}SbF_6^{-}$ catalyst powder (Cp=cyclopentadiene; also described as: (eta$^6$-xylenes)(eta$^5$-cyclopentadienyl)iron (1+) hexafluoroantimonate, as disclosed in U.S. Pat. No. 5,089,536 (Palazzotto)) in a WERNER & PFLIEDERER six zone 53-millimeter twin-screw extruder (available from Werner &

Pfliederer; Ramsey, N.J.) operating at a screw speed of 85 rpm. Zones 1 and 2 were unheated and the remaining zones were heated to 88° C. The extrudate produced therefrom was cooled in a three meter water bath at 10° C., then dried at ambient temperature using forced air, after which it was pelletized.

Example 2

Figure 6A:
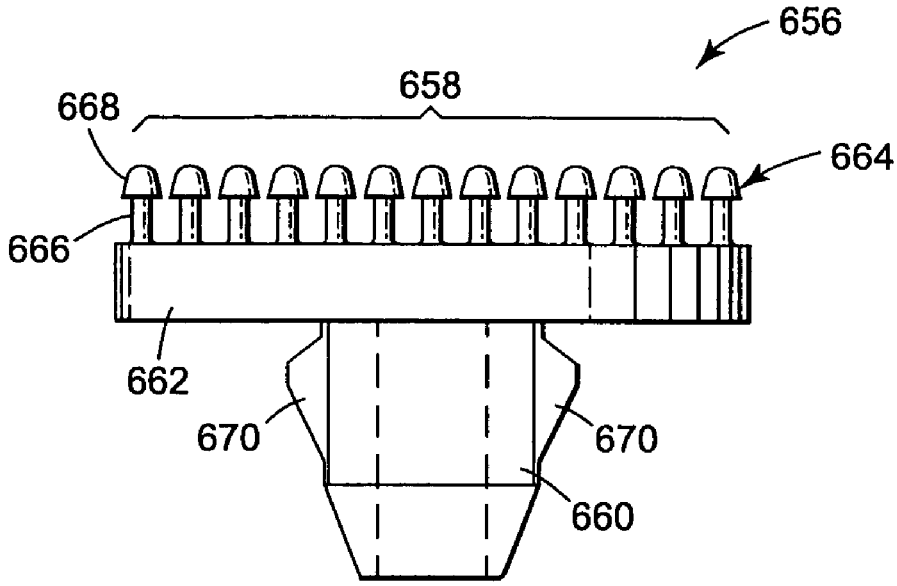
FIG. 6A is a cross-sectional representation of the curable mechanical fastener prepared in the Examples section.
Figure 6B:
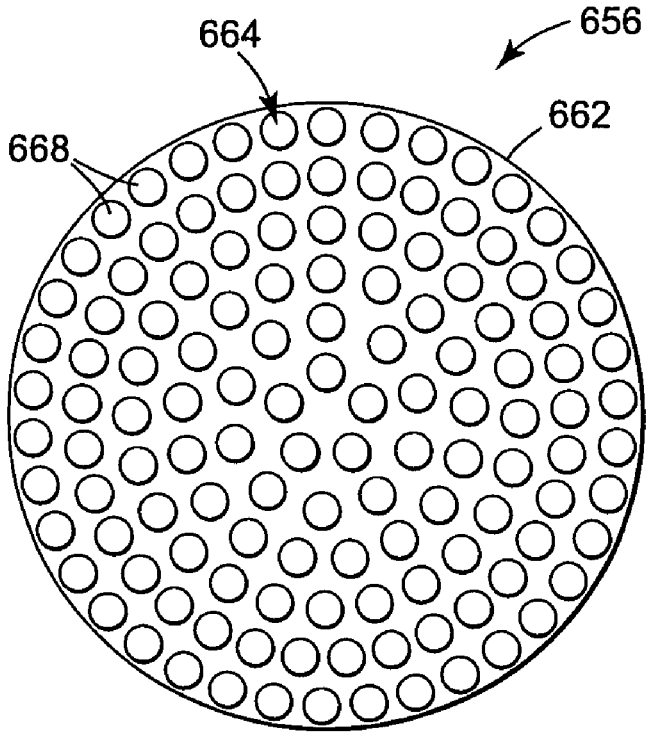
FIG. 6B is a top view of the curable mechanical fastener prepared in the Examples section.

Pellets were dried overnight at 49° C. in a convection oven. After drying, the pellets were injection-molded into mechanical fasteners 656 having fastening surfaces 658 as shown in FIG. 6A, with a top view of the fastening surface 658 shown in FIG. 6B, using a multi-part mold that was at least partially water-soluble, similar to those molds described in U.S. Pat. No. 5,242,646 (Torigoe et al.). The mold was dissolved from the curable mechanical fastener 656 by placing the assembly in a water bath for three days at room temperature, then drying for several hours at 49° C. in a convection oven.

After molding, the curable mechanical fasteners 656 were stored in a black (lightproof) plastic bag until used, unless otherwise noted. The curable mechanical fasteners 656 included a flange 660 coupled to the backside of a backing 662 from which a plurality of fastening elements 664 protruded. Each of the fastening elements comprised a stem 666 having a mushroom-shaped head 668. The flange 660 included side clips 670 for forming a mechanical bond to a substrate.

Example 3

This example describes curing conditions for curable mechanical fastener 656 constructions used in Examples 4–8. The curable mechanical fastener 656 construction was exposed to a super diazo blue light (using a Black Ray Lamp Model No. XX-15L, from UVP Inc.; San Gabriel, Calif., equipped with two super diazo bulbs, Model TLD15W/03 from Philips B.V., The Netherlands) at a distance of 15 centimeters for the time indicated. If B-staged, the construction was then placed in a convection oven heated to about 71° C. for about 10 to 15 hours.

After exposure to the super diazo blue light, the sample was placed in a convection oven heated to about 177° C. for 30 minutes at an inclined angle of 45° from horizontal, unless otherwise specified.

Example 4

A curable mechanical fastener 656, prepared as in Example 2, was attached to an e-coated panel (available under the trade designation, ED 5100, from Advanced Coating Technologies, Inc.; Hillsdale, Mich.) having a 0.8-centimeter hole by pushing the flexible flange 660 of the curable mechanical fastener 656 through the hole in the e-coated panel. Once inserted through the hole, the side clips 670 of the flexible flange 660 expanded to lock the curable mechanical fastener 656 in place with a mechanical bond.

The mushroom-stem fastening surface of a second curable mechanical fastener (having the same shape and composition as the first curable mechanical fastener) was mated to the mushroom-stem fastening surface 658 of the first curable mechanical fastener 656 and readily removed (and reattached) by hand with only slight apparent damage. Upon curing (using 10 minutes exposure to the light source described in Example 3 and no B-staging), the two curable mechanical fasteners melt-fused to the e-coated panel and to each other to form a permanent fastener. The permanent fastener could not be separated by hand.

Example 5

The flexible flange 670, as shown in FIG. 6A, was removed from a curable mechanical fastener prepared as in Example 2, resulting in a planar face on the backside of the backing 662. Adhesive tape (available under the trade designation, 3M STRUCTURAL BONDING TAPE 9245 from Minnesota Mining & Manufacturing Company of St. Paul, Minn.) was laminated to the planar face of the backing 662.

The assembly was adhered to a 2.5 centimeter×10 centimeter etched aluminum panel (obtained from Hiawatha Panel & Name Plate Co., Inc.; Minneapolis, Minn.), such that the adhesive tape layer was adjacent to and in contact with the aluminum panel.

The mushroom-stem fastening surface of a second curable mechanical fastener (having the same shape and composition as those prepared in Example 2) was mated to the mushroom-stem fastening surface of the first curable mechanical fastener. The second curable mechanical fastener was readily removable from the first curable mechanical fastener and reattachable by hand with only slight apparent damage.

The assembly was then cured by exposure to the light source described in Example 3 (for one hour on each exposed side) and further cured in the convection oven at a 60° angle from horizontal. After curing, the adhesive tape layer was firmly bonded to the aluminum. The mated mechanical fasteners, now a permanent mechanical fastener, slid approx. 0.6 centimeters along the adhesive tape layer and fused. The permanent fastener could not be separated by hand.

Example 6

The flexible flange 660 was removed from a curable mechanical fastener 656 prepared as in Example 2, resulting in a planar face on the backside of the backing 662. Adhesive tape, available under the trade designation 3M STRUCTURAL BONDING TAPE 9245 (available from Minnesota Mining & Manufacturing Co.; St. Paul, Minn.) was laminated to the now planar face. The assembly was adhered to a 2.5 centimeter×10 centimeter etched aluminum panel such that the adhesive tape layer was adjacent to and in contact with the aluminum panel.

A mushroom-stem conventional mechanical fastener (obtained under the trade designation, DUAL LOCK, from Minnesota Mining & Manufacturing Company; St. Paul, Minn.) was mated to the mushroom-stem fastening surface of the curable mechanical fastener. The conventional mechanical fastener was readily removable from the curable mechanical fastener and reattachable by hand with only slight apparent damage.

The assembly was then cured as described in Example 3 (with exposure to the super diazo lights for one hour on each exposed side). After curing the adhesive tape layer was firmly bonded to the aluminum panel. The curable mechanical fastener, now cured to form a permanent mechanical fastener, melted slightly, but retained its basic shape. The conventional mechanical fastener completely melted and lost its shape during cure.

Example 7

The flexible flange 660 was removed from a curable mechanical fastener 656 prepared as in Example 2, resulting in a planar face on the backside of the backing 662. Adhesive tape, available under the trade designation 3M STRUCTURAL BONDING TAPE 9245 (available from Minnesota Mining and Manufacturing Co.; St. Paul, Minn.) was laminated to the now planar face. The assembly was adhered to a 2.5 cm×10 cm etched aluminum panel such that the adhesive tape layer was adjacent to and in contact with the aluminum panel.

Loop tape (obtained as the loop portion of SCOTCH brand HOOK AND LOOP tape, available from Minnesota Mining & Manufacturing Company of St. Paul, Minn., having loops of fiber protruding from a backing layer) was mated to the fastening surface 658 of the curable mechanical fastener 656. The loop tape was readily removable from the curable mechanical fastener and reattachable by hand with only slight apparent damage.

The assembly was then cured as described in Example 3 (with exposure to the super diazo lights for one hour on each exposed side). No movement of the mechanical fastener was observed during cure. After curing, the adhesive tape layer was firmly bonded to the aluminum panel. The now cured mechanical fastener was permanently attached to the loop tape (i.e., it could not be readily removed without tearing the loop tape or destroying the mechanical fastener).

Example 8

Example 7 was repeated, except that the standard adhesive on backside of the loop tape was removed using solvent and it was replaced with an adhesive tape (3M STRUCTURAL BONDING TAPE 9245, available from Minnesota Mining & Manufacturing Co.; St. Paul, Minn.). A 1.5-gram steel disk was laminated to the adhesive tape attached to the loop material.

The laminated loop material was mated to the fastening surface of the curable mechanical fastener. The laminated loop material was readily removable from the curable mechanical fastener and reattachable by hand with only slight apparent damage.

The assembly was then cured as described in Example 3 (with exposure to the super diazo lights for one hour on each exposed side). No movement of the mechanical fastener was observed during cure. After curing, each adhesive tape layer was firmly bonded to its respective metal substrate and the complete bonded assembly could not be separated by hand.

Example 9

Two aluminum rods (2.5-centimeters diameter×5.1-centimeter length) were FPL acid-etched (such as can be done using FPL acid available from Forest Products Laboratories; Madison, Wis.) with the etch consisting of immersion in a sulfuric acid/chromic acid bath followed by a water rinse and drying) similar to that method described in U.S. Pat. No. 5,677,376. Onto one end of each rod was attached a curable mechanical fastener as prepared in Example 2 (with the flexible flange removed).

Adhesive tape, as described in Example 8, was laminated onto the backside of the curable mechanical fastener such that the adhesive tape layer was in contact with the aluminum rod. The curable mechanical fastener was exposed to the super diazo blue lights described in Example 3 for 30 minutes per side with no post bake.

The rods were mated via the curable mechanical fastener and placed in a tensile testing apparatus and separated at a rate of 5.1 centimeters per minute. The force required to separate the two curable mechanical fasteners was approximately 1 kilogram +/−0.1 kilogram. The assembly was then placed in an oven and cured at 177° C. for 30 minutes to provide a permanent fastener. The separation force was again measured. The force required two separate the assembly was 46 kilograms. The failure mode was cohesive.

Many other variations of the above-described invention would be apparent to those of ordinary skill in the art and are not described herein. This is not meant, however, to be limiting on the scope of the appended claims.

What is claimed is:

1. A curable mechanical fastener comprising:

a fastener consisting of a curable material with a fastening surface, and a complementary fastening surface, wherein the curable material comprises a combination of at least one thermosettable composition and at least one thermoplastic composition; and wherein the fastening surface is capable of being repeatedly attached and unattached to the complementary fastening surface, and wherein the fastening surface is capable of becoming permanently attached to the complementary fastening surface when cured.

2. The curable mechanical fastener of claim 1, wherein the curable mechanical fastener is reclosable for at least one hour after fabrication.

3. The curable mechanical fastener of claim 1, wherein the curable mechanical fastener is reclosable for at least one month after fabrication.

4. The curable mechanical fastener of claim 1, wherein the thermosettable composition comprises at least one thermosettable material selected from the group consisting of (meth)acrylates, urethanes, ethers, epoxies, cyanates, esters, phenolics, polyimides, amine formaldehyde condensates, and mixtures thereof.

5. The curable mechanical fastener of claim 1, wherein the thermosettable composition comprises an epoxy.

6. The curable mechanical fastener of claim 1, wherein the thermoplastic composition comprises at least one thermoplastic material selected from the group consisting of polyesters, polyolefins, polyamides, polyethers, polyurethanes, plasticized polyvinyl chloride, thermoplastic elastomer block copolymers, phenoxy resins, polyketones, silicones, polyetherimides, polycarbonates, polysulfones, polyoxides, and mixtures thereof.

7. The curable mechanical fastener of claim 1, wherein the thermoplastic composition comprises a polyester.

8. The curable mechanical fastener of claim 7, wherein the polyester is semi-crystalline at room temperature.

9. The curable mechanical fastener of claim 1, wherein the thermosettable composition comprises an epoxy and the thermoplastic composition comprises a polyester.

10. The curable mechanical fastener of claim 1, wherein the curable mechanical fastener is a hook-and-loop mechanical fastener.

11. The curable mechanical fastener of claim 1, wherein the fastening surface comprises protruding fastening elements and the complementary fastening surface comprises recessed structures.

12. The curable mechanical fastener of claim 1, wherein the fastener is formed by a method selected from the group consisting of extruding, melt-blowing, molding, and microreplicating.

13. A mechanical fastener according to claim 1 which has been cured.

14. The cured mechanical fastener according to claim 13, wherein the curable mechanical fastener is cured using actinic radiation.

15. The cured mechanical fastener according to claim 13, wherein the cured mechanical fastener has an overlap shear strength of at least about 7 MPa.

16. A method of forming a permanent fastener comprising the steps of:

providing a curable mechanical fastener according to claim 1;

attaching the fastening surface to the complementary fastening surface; and curing the mechanical fastener to provide a permanent fastener.

17. The method of claim 16, further comprising the step of attaching the curable mechanical fastener to a substrate.

18. The method of claim 17, wherein the curable mechanical fastener is permanently attached to the substrate.

19. The method of claim 16, wherein the complementary fastening surface is part of a curable mechanical fastener, the method further comprising the step of permanently attaching the curable mechanical fastener comprising the complementary fastening surface to a substrate.

20. A curable mechanical fastener comprising:

a fastening surface comprising a plurality of fastening elements consisting of a curable material coupled to a backing, and a complementary fastening surface, wherein the fastening surface is capable of being repeatedly attached and unattached to the complementary fastening surface, and wherein the fastening surface is capable of becoming permanently attached to the complementary fastening surface when cured.

21. The curable mechanical fastener of claim 20, wherein at least one fastening element is mushroom-shaped.

22. A multi-part curable mechanical fastener, comprising:

a first part comprising a fastening surface;

a second part comprising a complementary fastening surface that complements the fastening surface;

wherein at least one of the first part comprising the fastening surface and the second part comprising the complementary fastening surface consists of a curable material comprising a combination of at least one thermosettable composition and at least one thermoplastic composition, such that when the fastening surface is mechanically attached to the complementary fastening surface, the multi-part curable mechanical fastener is capable of being cured to provide a permanent fastener.

23. The curable mechanical fastener of claim 22, wherein both the fastening surface and the complementary fastening surface comprises a curable material.

24. The curable mechanical fastener of claim 23, wherein the curable material of either the fastening surface or the complementary surface comprises a functionalized-thermoplastic composition.

* * * * *

UNITED STATES PATENT AND TRADEMARK OFFICE

CERTIFICATE OF CORRECTION

PATENT NO. : 7,018,496 B1
APPLICATION NO. : 09/299965
DATED : March 28, 2006
INVENTOR(S) : Clayton A. George It is certified that error appears in the above-identified patent and that said Letters Patent is hereby corrected as shown below:

On Title Page, Item (56) On Page 2, under "Other Publications", line 1, delete "Schotmate" and insert -- Scotchmate --, therefor.

On Title Page Item (56) On Page 2, under "Other Publications", line 6, delete "vol" and insert -- vol. --, therefor.

In Col. 20, line 5, delete "+/-0.1" and insert -- +/- 0.1 --, therefor.

Signed and Sealed this

Third Day of April, 2007

JON W. DUDAS
*Director of the United States Patent and Trademark Office*